US008193476B2

(12) United States Patent
Olden et al.

(10) Patent No.: US 8,193,476 B2
(45) Date of Patent: Jun. 5, 2012

(54) SOLID-FUEL PELLET THRUST AND CONTROL ACTUATION SYSTEM TO MANEUVER A FLIGHT VEHICLE

(75) Inventors: Thomas A. Olden, Tucson, AZ (US); Robert Cavalleri, Coral Springs, FL (US); Lloyd E. Kinsey, Jr., Tucson, AZ (US)

(73) Assignee: Raytheon Company, Waltham, MA (US)

( * ) Notice: Subject to any disclaimer, the term of this patent is extended or adjusted under 35 U.S.C. 154(b) by 915 days.

(21) Appl. No.: 12/203,302

(22) Filed: Sep. 3, 2008

(65) Prior Publication Data

US 2010/0032516 A1 Feb. 11, 2010

Related U.S. Application Data

(60) Provisional application No. 61/061,239, filed on Jun. 13, 2008.

(51) Int. Cl.
*F42B 15/01* (2006.01)

(52) U.S. Cl. ..... 244/3.27; 244/3.24; 244/3.26; 244/200.1; 244/201; 244/204; 89/1.14; 102/377; 102/490

(58) Field of Classification Search ..... 102/381, 102/377, 388, 490; 89/1.14; 244/3.24, 3.27, 244/3.29, 3.26, 91, 200, 200.1, 201, 204
See application file for complete search history.

(56) References Cited

U.S. PATENT DOCUMENTS 1,218,832 A * 3/1917 Bondurant ..... 102/400
3,304,030 A * 2/1967 Weimholt et al. ..... 244/3.28
3,504,869 A 4/1970 Evans et al.
4,013,245 A 3/1977 Vanbuskirk
4,113,204 A 9/1978 Leek
4,149,166 A 4/1979 Null
4,364,531 A 12/1982 Knoski
4,512,537 A 4/1985 Sebestyen et al.
4,884,766 A * 12/1989 Steinmetz et al. ..... 244/3.27
4,944,226 A * 7/1990 Wedertz et al. ..... 102/476
5,211,358 A 5/1993 Bagley
5,379,968 A 1/1995 Grosso
5,452,864 A 9/1995 Alford et al.
5,507,452 A 4/1996 Mayersak
5,512,537 A 4/1996 Tsang
5,657,947 A 8/1997 Mayersak
5,762,291 A 6/1998 Hollis et al.
5,775,636 A 7/1998 Vig et al.
5,816,531 A 10/1998 Hollis et al.
5,826,821 A 10/1998 Brandon et al.
(Continued)

*Primary Examiner* — Timothy D Collins
*Assistant Examiner* — Philip J Bonzell
(74) *Attorney, Agent, or Firm* — Eric A. Gifford

(57) ABSTRACT

A solid-fuel pellet thrust and control actuation system (PT-CAS) provides command authority for maneuvering flight vehicles over subsonic and supersonic speeds and within the atmosphere and exo-atmosphere. The PT-CAS includes a chamber or solid-fuel pellets that are ignited to expel gas through a throat. The expelled gas is directed at supersonic vehicle speeds in atmosphere to a cavity between an aero control surface and the airframe to pressurize the cavity and deploy the surface or at subsonic speeds in atmosphere or any speed in exo-atmosphere allowed to flow out a through-hole in the surface where the throat and through-hole provide a virtual converging/diverging nozzle to produce a supersonic divert thrust. A pellet and control actuation system (P-CAS) without the through-hole provides command authority at supersonic speeds in atmosphere. A restrictor mechanism controls the bleed of pressurized gas from the cavity to the external environment to achieve a deployment time objective for either the PT-CAS or P-CAS.

27 Claims, 13 Drawing Sheets

U.S. PATENT DOCUMENTS

| | | | | |
|---|---|---|---|---|
| 5,886,257 | A | 3/1999 | Gustafson et al. | |
| 6,135,387 | A | 10/2000 | Seidel et al. | |
| 6,234,082 | B1 | 5/2001 | Cros et al. | |
| 6,283,407 | B1 | 9/2001 | Hakenesch | |
| 6,310,335 | B1 | 10/2001 | Bonnet et al. | |
| 6,325,325 | B1 | 12/2001 | Bonnet et al. | |
| 6,345,785 | B1 | 2/2002 | Harkins et al. | |
| 6,454,205 | B2 * | 9/2002 | Niemeyer et al. | 244/3.26 |
| 6,474,593 | B1 | 11/2002 | Lipeles et al. | |
| 6,502,785 | B1 | 1/2003 | Teter et al. | |
| 6,502,786 | B2 | 1/2003 | Rupert et al. | |
| 6,779,754 | B2 * | 8/2004 | Hellman | 244/3.27 |
| 6,886,775 | B2 * | 5/2005 | Johnsson et al. | 244/3.27 |
| 7,226,016 | B2 * | 6/2007 | Johnsson et al. | 244/3.28 |
| 2001/0030260 | A1 * | 10/2001 | Niemeyer et al. | 244/3.26 |
| 2003/0146342 | A1 * | 8/2003 | Hellman | 244/3.27 |
| 2004/0011919 | A1 * | 1/2004 | Johnsson et al. | 244/3.29 |
| 2004/0094661 | A1 * | 5/2004 | Johnsson et al. | 244/3.27 |
| 2007/0084961 | A1 * | 4/2007 | Johnsson et al. | 244/3.28 |

* cited by examiner

SOLID-FUEL PELLET THRUST AND CONTROL ACTUATION SYSTEM TO MANEUVER A FLIGHT VEHICLE

CROSS-REFERENCE TO RELATED APPLICATIONS

This application claims benefit of priority under 35 U.S.C. 119(e) to U.S. Provisional Application No. 61/061,239 entitled "Solid-Fuel Pellet Thrust and Control Actuation System to Maneuver a Flight Vehicle" and filed on Jun. 13, 2008, the entire contents of Which are incorporated by reference.

BACKGROUND OF THE INVENTION

1. Field of the Invention

This invention relates to a solid-fuel pellet thrust and control actuation system (CAS) for providing command authority to maneuver a flight vehicle over an entire vehicle speed range encompassing both the subsonic and supersonic Mach numbers and within the atmosphere and exo-atmosphere.

2. Description of the Related Art

Flight vehicles such as self-propelled missiles, gun or tube launched guided projectiles, kinetic interceptors and unmanned aerial vehicles require command authority, to maneuver the vehicle to perform guidance and attitude control. Each of these vehicles may operate over a speed range encompassing both subsonic and supersonic Mach numbers and within the atmosphere and exo-atmosphere during a single mission. The differing speed and atmospheric conditions present different problems for effectively maneuvering the vehicle under volume, weight and cost constraints imposed by the vehicle and mission.

One approach used in a majority, if not all missile products employs a Control Actuation System (CAS) for guidance to the target. Typically the CAS employs a set of four fin control surfaces actuated by individual servo motors. Actuation of the fin control surfaces into the onrushing free stream produces drag and directional forces to maneuver the vehicle. Control surfaces are effective at supersonic speeds above Mach 1 in atmosphere where sufficient drag and force is produced to quickly maneuver the vehicle. However at subsonic speeds in atmosphere the amount of drag and force is relatively small and maneuverability is limited. In the exo-atmosphere, actuation of the fin control surface is wholly ineffective because no drag or force is produced. Furthermore the servo motors are very expensive, up to 25% of the missile cost, and have reliability issues related to the moving parts of the servo motor being exposed to ver high g loads at launch.

Another approach is to use divert thrusters (or attitude thrusters) that expel stored or combustion gas through a nozzle producing a force to directly maneuver the vehicle. A liquid-fuel divert thruster system includes one or more liquid or gas storage tanks and a regulator valve to mix and a combustion chamber to burn the liquid or gas propellants. The liquid propellant configurations are comprised of either monopropellant systems or bipropellant systems where the bipropellant system contains a fuel and an oxidizer. Liquid-fuel has the advantage that the amount of thrust can be continuously varied, started and stopped, and may be less expensive than servo motors. However, these systems are large and heavy. Liquid propellant divert thruster systems are used in space-based platforms such as satellites and kinetic kill-vehicles. A solid-fuel propellant system is more light weight and less complicated but once ignited burns until completion where all the solid fuel has been consumed. A variant on the solid-fuel propellant system are "pyrotechnic thrusters" or "poppers" that generate a thrust pulse, Pyrotechnic thrusters can be effectively employed in the subsonic regime of the vehicle flight in atmosphere and also exo-atmospheric.

The liquid or solid-fuel propellant divert thrusters are not as effective as control surfaces such as fins at supersonic speeds in atmosphere. The on rushing high speed free stream relative to the vehicle has such a high degree of momentum in conjunction with the high vehicle momentum that the divert jet thrust is only marginally effective unless unrealistically large divert thrusters are employed. A divert thruster system would have to burn for a long time in order to maneuver. Long burn times at supersonic speeds create a vehicle packaging problem because of the volume requirements imposed by the amount of propellant required. The ability of the vehicle to maneuver quickly, which is critical in many military applications, is also limited at supersonic speeds.

SUMMARY OF THE INVENTION

The present invention provides a solid-fuel pellet thrust and control actuation system for maneuvering flight vehicles over subsonic and supersonic speeds at flight conditions within the atmosphere and also exo-atmosphere.

Command authority at supersonic speeds in atmosphere is accomplished by providing an airframe having a pivotable aerodynamic control surface that is recessed within the airframe and a cavity there between. One or more solid-fuel pellets are ignited to expel gas that flows into the cavity creating a cavity pressure that overcomes the external pressure forcing the control surface to deploy. The resulting drag and force maneuver the airframe. The flow of pressurized gas from the cavity to the external environment is restricted to meet a deployment time objective. The gas may be used to inflate an air bag to deploy the control surface with the porosity of the fabric controlling the bleed of pressurized gas to the environment.

To provide additional maneuvering capability at subsonic speeds in atmosphere and in the exo-atmosphere, the control surface is formed with a through-hole above a throat in the airframe that together form a virtual converging/diverging nozzle. At subsonic vehicle speeds in Earth atmosphere or in the exo-atmosphere, the nozzle expels gas through the hole in the control surface at supersonic speed producing a divert thrust and force to maneuver the airframe without pressurizing the cavity to deploy the surface. At supersonic speeds in Earth atmosphere, the nozzle expels gas that obstructs the free stream producing a shock that in turn restricts gas flow from the nozzle directing at least a portion of the gas into the cavity to pressurize the cavity and actuate the control surface. At low supersonic speeds within a transition region command authority, is a combination of divert thrust and surface deployment. At a certain supersonic Mach number ($M>1$) substantially all of the gas is diverted into the cavity so that command authority is effectively only the deployment of the aero surface.

In essence, at subsonic speeds in atmosphere or in the exo-atmosphere the solid-fuel pellet thrust and CAS functions as a divert or attitude thruster. At supersonic speeds in atmosphere the free stream essentially plugs the nozzle so that the solid-fuel pellet thrust and CAS functions to deploy the aerodynamic control surface. The solid-fuel pellet thrust and CAS provides the capability to operate over subsonic and supersonic speeds and within atmosphere and exo-atmosphere and deploys the most efficient means of maneuvering the flight vehicle depending on the operating regime.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a solid-fuel pellet thrust and control actuation system for maneuvering flight vehicles over subsonic and supersonic speeds and within the atmosphere and exo-atmosphere. The system is compact, lightweight, inexpensive and reliable in that it requires no moving parts other than the aerodynamic control surface. The described system is generally applicable to a wide variety of flight vehicles including self-propelled missiles, gun or tube launched guided projectiles, kinetic interceptors and supersonic unmanned aerial vehicles but not limited thereto. The system is useful with fin stabilized vehicles or spin stabilized vehicles with the addition of for example, a centripetal spring that offsets the centrifugal force on the spinning vehicle. This low-cost system is of particular importance to developing low cost countermeasures to intercept and destroy threats. A base embodiment of a pellet control actuation system or P-CAS uses solid-fuel pellets to actuate a control surface with particular effectiveness in the supersonic regime within atmosphere. Another embodiment of a pellet thrust and control actuation system or 'PT-CAS' adds a virtual converging/diverging nozzle formed by a through-hole in the control surface and a throat to the gas chamber to provide additional divert thrust capability for improved maneuverability at subsonic speeds in atmosphere or at any speed in the exo-atmosphere. Roll control functionality can be provided in either the base P-CAS or more advanced PT-CAS embodiments by locating a roll control port on the side of the aerodynamic control surface. Gas flowing through this port creates a force on the vehicle circumferential direction, resulting in the vehicle rotating (rolling) about its longitudinal axis. These ports are located on alternate sides of consecutive control surfaces.

Figure 1:
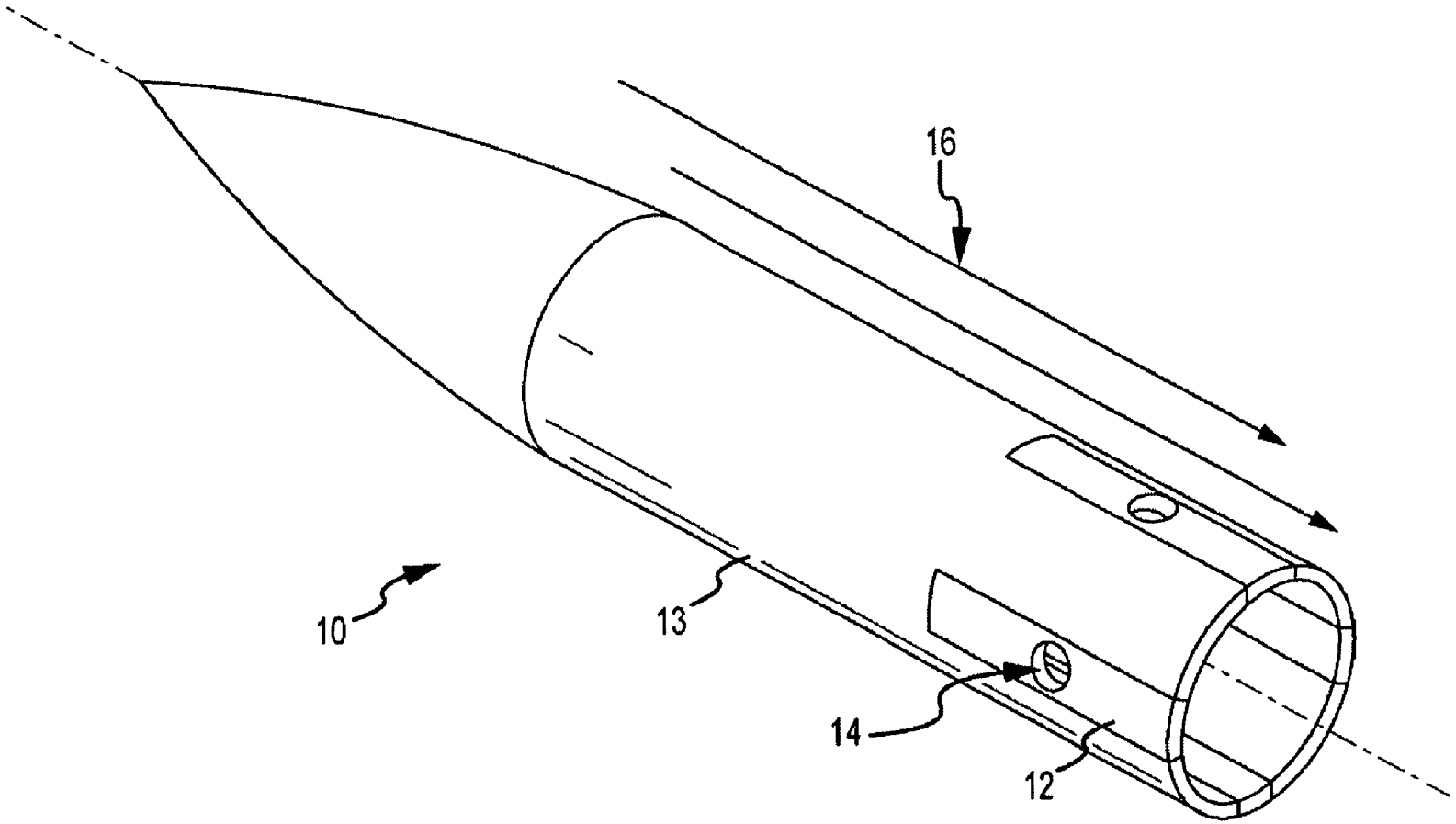
FIG. 1 is a diagram of a flight vehicle having a set of hinged aero control surfaces for providing command authority to maneuver the vehicle.
Figure 2:
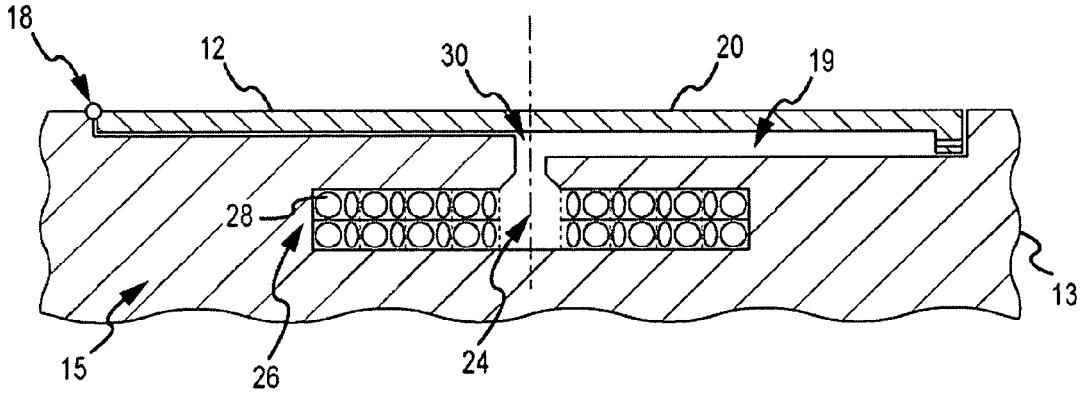
FIG. 2 is an enlarged view of the tail section illustrating an embodiment of solid-fuel pellet CAS.

As shown in FIG. 1, a flight vehicle 10 such as a missile includes a set of four aerodynamic control surfaces 12 commonly referred to as fins, flaps or canards pivotably mounted on an airframe 13. In one embodiment, a through-hole 14 formed in a fore section of surface 12 forms a portion of a virtual converging/diverging nozzle. A CAS ignites solid-fuel pellets to produce a gas stream. This gas stream is either expelled from through-hole 14 at supersonic speeds to produce a divert thrust to maneuver the airframe or is directed into a cavity between an aft section of the control surface and the airframe to pressurize the cavity and actuate the control surface 12 to maneuver the airframe. At subsonic speeds in atmosphere or at any speed in the exo-atmosphere, the gas stream is expelled from the nozzle with little or no resistance from the on rushing free stream 16 to produce the divert thrust. The control surface remains recessed within the airframe. At supersonic speeds in atmosphere, the interaction of the expelled gas and the free stream 16 produces a 'shock', which in turn creates a 'virtual plug' that obstructs the through-hole diverting at least a portion of the gas into the cavity. At sufficiently high Mach numbers the divert thrust is negligible. Exhaust gas is 'bled' from the cavity at a controlled rate to achieve a deployment time objective. This exhaust gas can be directed to pressurize the base region at the trailing edge of the airframe to reduce 'base drag'.

An embodiment of the solid-fuel pellet CAS (P-CAS) 15 without the virtual converging/diverging nozzle is illustrated in FIGS. 2-5. Although this CAS can provide some maneuverability at subsonic speeds in atmosphere it is particularly directed at supersonic speeds in atmosphere. This embodiment provides similar control to a conventional servo motor CAS but is less expensive.

Aerodynamic control surface 12 on airframe 13 is pivotable about a pivot point 18 between a retracted position out of the free stream 16 and deployed positions in the free stream to provide drag to maneuver the airframe. The control surface may be hinged or flexed to pivot about the point. A cavity 19 is positioned aft of the pivot point between an aft section 20 or the control surface and airframe 13. As shown here the cavity is formed by a recess 22 in the surface of airframe 13. Alternately, the cavity, may be formed by a recess in the aft section of the control surface or a combination of the two recesses.

A chamber 24 including one or more propellant chambers 26 each holding one or more solid-fuel pellets 28 is disposed inside the airframe. A throat 30 couples the chamber to the cavity. An ignition system 32 ignites the solid-fuel pellets in one or more propellant chambers to expel gas 34 that flows through the throat into the cavity to pressurize the cavity and deploy the control surface. The cavity could extend the length of the surface. Limiting the cavity to an aft section of the surface provides for better propellant gas utilization and increased efficiency.

The ignition system includes an 'electric match' 36 coupled to each propellant chamber and wires 38 connected to a controller 40. Electric match 36 may be a small charge of flammable material that, when burned, releases a predetermined amount of hot combustion gases sufficient to ignite the pellets. The combustion of the igniter may be initiated, for example, by an electric current flowing through a heater wire adjacent to, or embedded in, the flammable igniter material. The controller 40 decides when to fire one or more propellant chambers to maneuver the flight vehicle. A current signal sent from the controller over the spires ignites the electric match which in turn ignites the solid-fuel pellet. The ignition system requires no moving parts to actuate the control surface between deployed positions and the retracted position.

Each solid fuel pellet may be composed of at least some of an energetic fuel material and an oxidizer material. Each fuel pellet may contain additional binder and/or plasticizer material. The binder material and the plasticizer material may be reactive and may serve as a fuel material and/or an oxidizer material. Suitable compositions for gas generator solid fuel pellets are well known. The solid-fuel pellets are suitably formed from guanidine (or guanidinium) nitrate and basic copper nitrate, cobalt nitrate, and combinations thereof, as described in U.S. Pat. No. 5,608,183. At least 60% of the total mass of the fuel pellets may be composed of guanidine nitrate and basic copper nitrate. The solid fuel pellets may have relatively low combustion temperatures, for example between 1500° C. and 2000° C.

Solid-fuel pellets may be fabricated in large lots. The performance of each batch of fuel pellets may be verified by lot sample tests, in which randomly selected samples from throughout the lot are tested. A determination may be made if the test data from the lot sample tests indicates that the lot of fuel pellets is good and within specification limits. Assuming the lot of fuel pellets is determined to be good; the test data from the lot sample tests may be analyzed to determine the exact quantity of fuel pellets that should be loaded into the propellant chambers. The quantity of fuel pellets may be determined as a specific number of pellets or as some other convenient metric such as the total weight or mass of the pellets to be loaded into the rocket motor. The ability to adjust the number or weight of the pellets loaded into the propellant chamber may allow precise control or the total impulse that may be produced by the rocket motor.

A restrictor mechanism 42 is provided to control the bleed of exhaust gas 44 from the cavity to the external environment to achieve a deployment time objective. The restrictor mechanism is needed to allow the cavity to be pressurized to deploy the control surface and to depressurize the cavity to allow the surface to be retracted. If gas flow from the cavity to the external environment were not restricted at all the gas would simply vent to the external environment and the cavity would not pressurize. Conversely if gas flow was completely restricted the cavity would not depressurize. The rate at which gas is bled out of the cavity can be constant or variable with cavity pressure or deployment angle to achieve the deployment time objective.

Figure 3A:
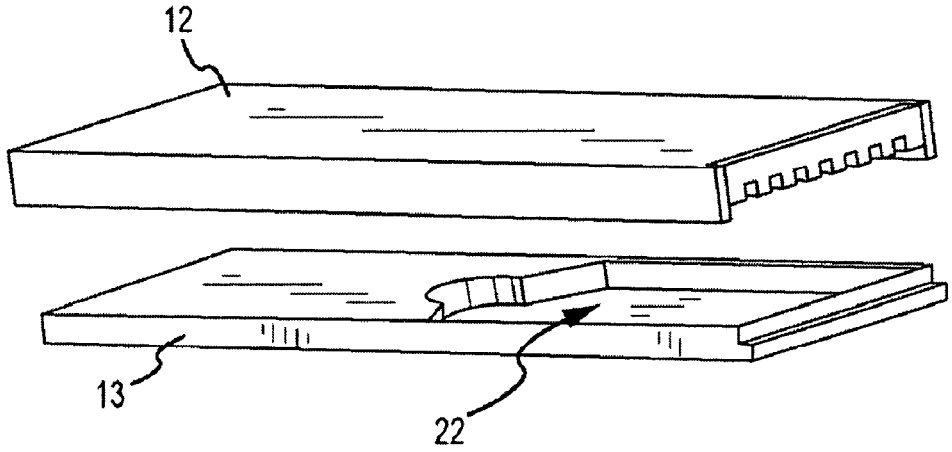
FIGS. 3*a* and 3*b* are an exploded view of a control surface assemble and an enlarged view of the tail section illustrating the deployed surface.
Figure 3B:
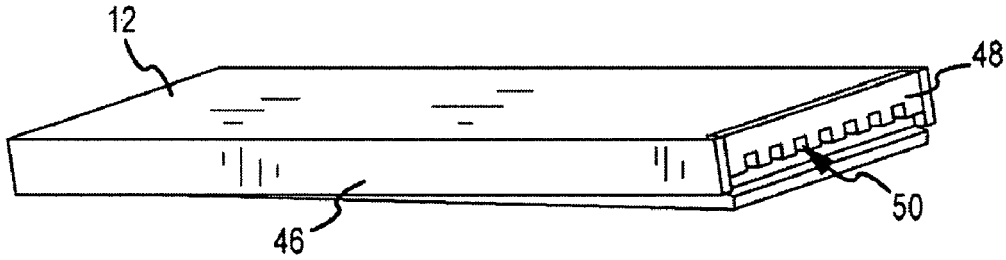
Figure 4:
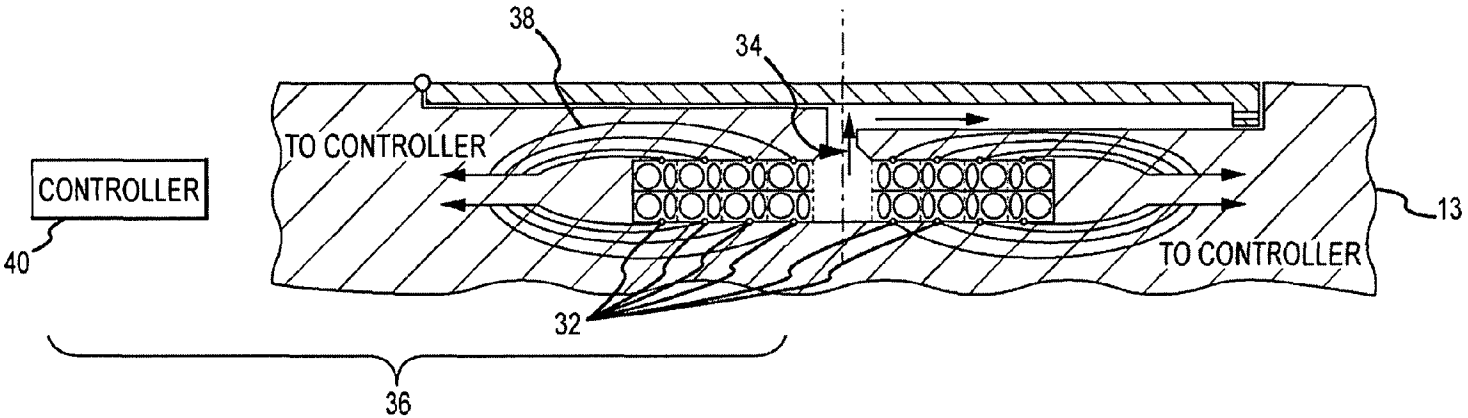
FIG. 4 is a diagram of an ignition system for firing the solid-fuel pellets.

As best shown in FIGS. 3*a* and 3*b*, in one embodiment the restrictor mechanism 42 includes side panels 46 and an endplate 48 having vent holes or slots 50 formed therein. Side panels 46 are disposed on opposite sides of aero control surface 12 longitudinally from the pivot point to the aft end of the surface. In the retracted surface position, the side panels are recessed inside the airframe. When the control surface is actuated to a deployed position, the side panels still overlap the airframe to prevent exhaust gas from escaping as best shown in FIG. 3*b*. Typical deployment angles are fairly small in many flight vehicles, approximately 5-15°. Endplate 48 is disposed on the aft end of the control surface and is recessed within the airframe when the surface is in its retracted position. When the control surface is actuated to a deployed position, vents 48 rise above the surface of the airframe providing passageways from cavity 19 to the external environment. The pressurized gas in the cavity bleeds through the vents to the external environment at a controlled rate. The pattern of vents may be configured to provide a uniform or variable bleed rate with angle of deployment. Other restrictor mechanisms that provide the desired functionality are contemplated and within the scope of the present invention. For example, the side panels and end plate could be replaced with a soft 'bellows' mechanism.

Figure 5:
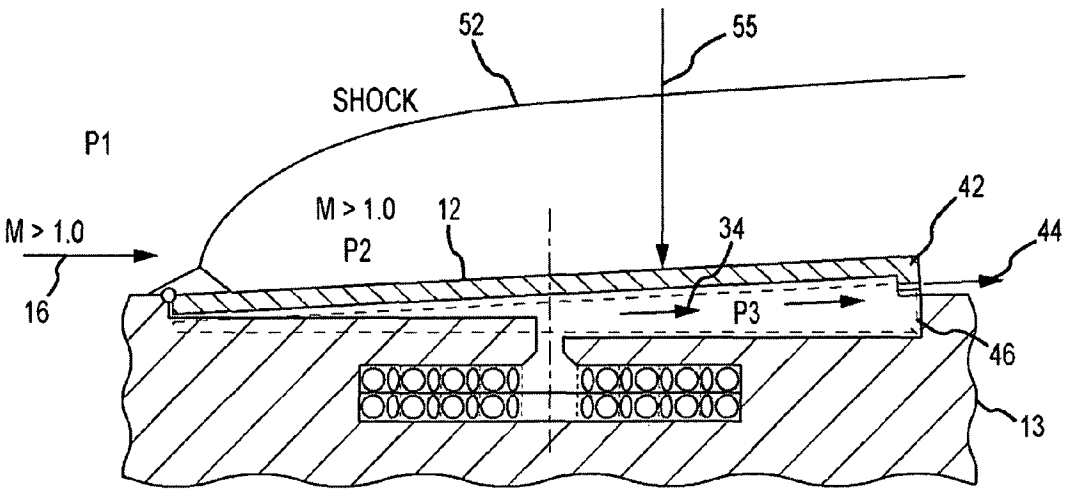
FIG. 5 is a diagram illustrating the pressurization of the cavity and controlled bleed of high pressure gas from the cavity to the external environment to control surface deployment.

As shown in FIG. 5, free stream 16 flows over the airframe at supersonic speeds (Mach>1) with a leading free stream static pressure P1. The ignition system ignites one or more solid-fuel pellets to expel gas 34 that flows through the throat into the cavity creating an aggregate cavity pressure P3 that forces the control surface to actuate to a deployed position. Deployment of the control surface into the supersonic free stream 16 produces a shock 52. The pressure P2 downstream of the shock is the external free stream aggregate pressure on the exterior of the control surface. The aggregate pressure is the exterior or cavity pressure averaged over the surface to compensate for any local variations. When P3>P2, the control surface is actuated to a deployed position. The free stream total pressure Pt (upstream of the shock) is the static pressure plus the dynamic pressure given by $Pt=P1+0.5*\rho*V^2$ where $\rho$ is the free stream density and V is the vehicle velocity.

In the deployed position, the control surface in atmosphere produces a drag force, which in turn produces a force 55 which is normal to the vehicle longitudinal axis to maneuver the airframe. Once deployed, the exhaust gas 44 flows through the vents to the external environment. The forcing function produced by igniting the solid-fuel pellets is strong and fast causing the control surface to move to the desired deployed position rapidly. Once the forcing function is removed, the external free stream aggregate pressure will force the control surface, against the resistance of the restrictor mechanism to bleed the exhaust gas to the external environment, back to its recessed position. For example, the control surface may be actuated to its deployed position in 1 to 10 ms and, once the forcing function is removed, return to its recessed position in 1 to 10 ms. Actuation may be assisted by a spring mechanism that prevents deployment until the forcing function exceeds a threshold and assists with retracting the control surface when the forcing function is removed.

The controller 40 decides when to fire one or more propellant chambers to actuate the control surface to maneuver the flight vehicle. The controller may operate "open-loop" generating the ignition sequence based on parameters such as the deployment angle, deployment time, vehicle air speed, vehicle altitude etc. The controller uses these parameters to calculate or look-up (from a precalculated table) the desired ignition sequence. This ignition sequence may compensate for such factors in the change in force on the control surface as it deploys and the change in volume, hence pressure of the cavil. Alternately, the controller may operate "closed-loop" to modify the above ignition sequence based on one or more sensed parameters. For example, sensors could be deployed on the airframe to measure the deployment angle of the surface or the cavity pressure in real-time and feed those parameters back to the controller. The controller could than alter the ignition sequence to maintain the desired deployment angle for a specified time.

Figure 6A:
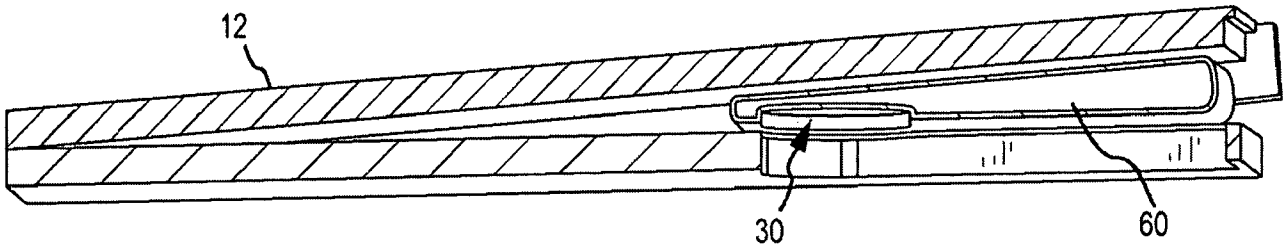
FIGS. 6*a* and 6*b* are diagrams of an alternate embodiment of a solid-fuel pellet CAS.
Figure 6B:
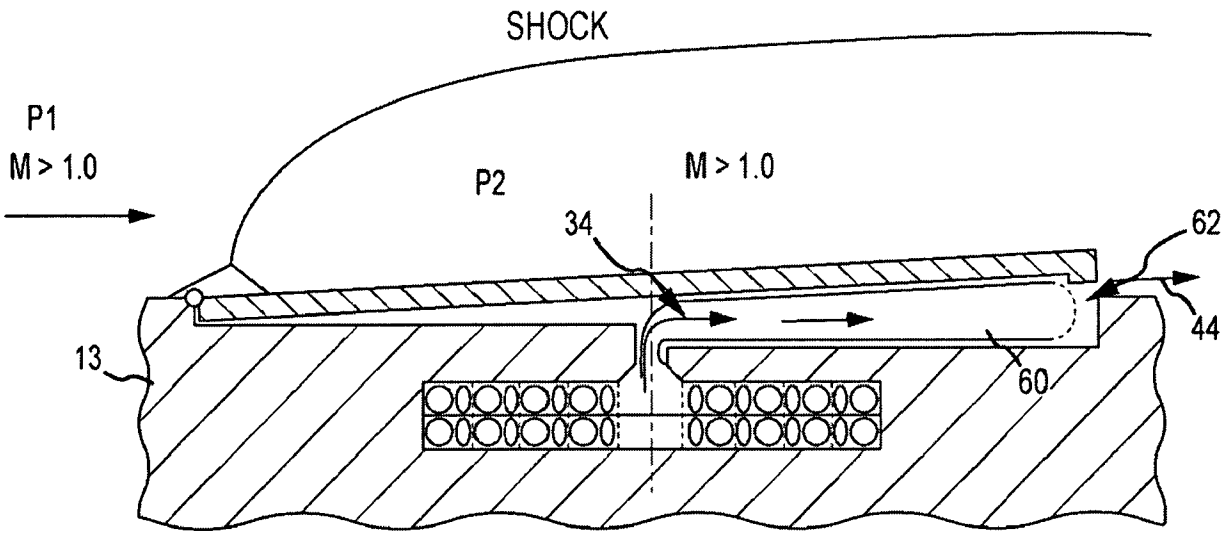

In another embodiment shown in FIGS. 6*a* and 6*b*, a fabric bag 60 is disposed in cavity 19 and coupled to throat 30 so that gas 34 inflates the bag to deploy the surface 12. The porosity of the fabric forms the restrictor mechanism to control the bleed of exhaust gas 44 from the cavity. The fabric may have a uniform porosity to bleed gas from both sides and the end. Alternately the fabric may be more or only porous at the aft end 62 to bleed the exhaust gas to, for example, pressurize the base region of the flight vehicle.

An embodiment of a PT-CAS 70 with a virtual converging/diverging nozzle 72 is illustrated in FIGS. 7-11. This PT-CAS can provide effective maneuverability at subsonic speeds in atmosphere and at supersonic speeds in atmosphere. This embodiment effectively combines the functionality of both a divert thruster and a servo motor CAS and is less expensive. For purposes of clarity and brevity but without loss of generality like numbers for elements in P-CAS 15 without divert thrust capability will be used for like elements in PT-CAS 70 with divert capability.

Figure 7A:
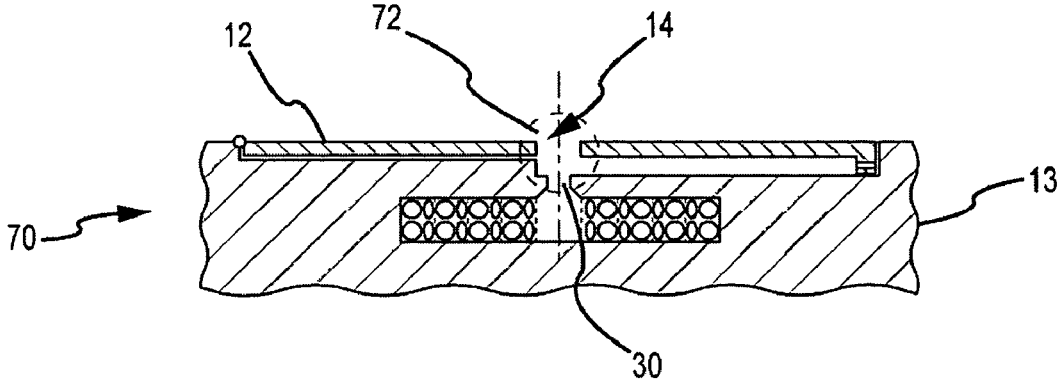
FIGS. 7*a* through 7*c* are different views of an alternate embodiment of the thrust and CAS providing both divert thrust and control of the aero control surface.
Figure 7B:
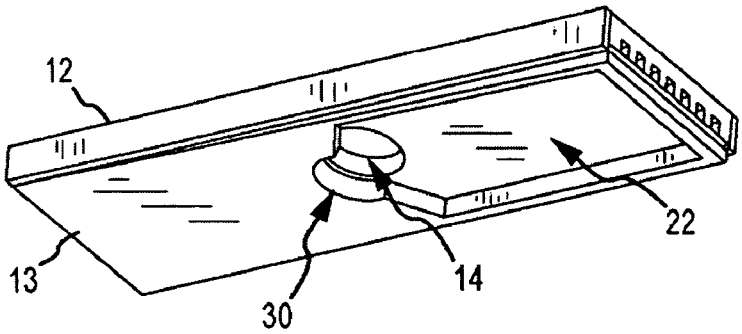
Figure 7C:
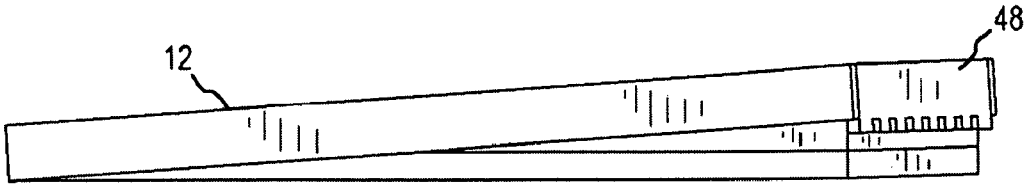

As illustrated in FIGS. 7*a*-7*c* of PT-CAS 70, the only required modification to the base P-CAS embodiment to provide the additional divert thruster capability is the formation of through-hole 14 in aero control surface 12 above throat 30 to form virtual converging/diverging nozzle 72. The through-hole has a larger diameter than the throat. The cavity 19, propellant chambers 26, ignition system 32, restrictor mechanism 46 and controller 40 are functionally the same. Ale specific design of each component will vary with application and mission requirements e.g. total propellant required, deployment time objective, etc. The requirements on the throat are relaxed in the base embodiment. The throat need only direct the combusted gas to the cavity and not form a nozzle that provides a supersonic transition to the expelled gas.

Figure 8:
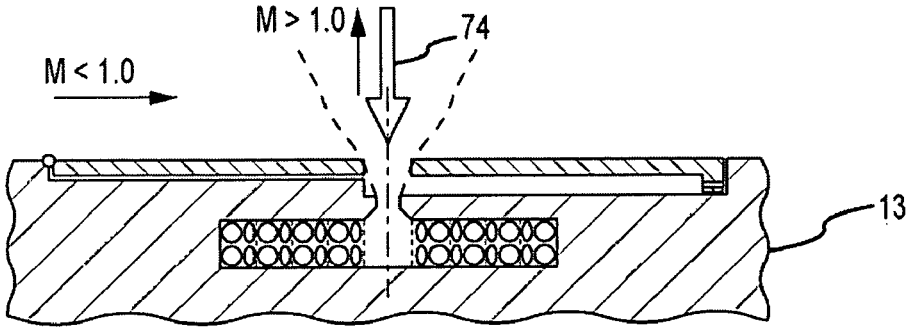
FIG. 8 is a diagram illustrating operation of the CAS at subsonic speeds in Earth atmosphere or at an), speed outside Earth atmosphere.

As shown in FIG. 8, at subsonic vehicle speeds in Earth atmosphere or in the exo-atmosphere, when the controller ignites one or more of the propellant chambers at the same time or in a desired sequence, gas 34 is expelled into the chamber at a subsonic speed (M<1) and experiences a sonic transition crossing Mach 1 as it flows through the throat 30 and exits through-hole 14 at supersonic speeds (M>1.0) producing a divert thrust 74 (downward force) to maneuver the airframe without pressurizing the cavity to deploy the surface. As the speed of the combusted gas increases from the chamber through the throat and expelled from the nozzle, the pressure drops. The desired nozzle exit velocity and pressure can be achieved by proper design of the nozzle geometry, which is well known in the relevant art.

Figure 9A:
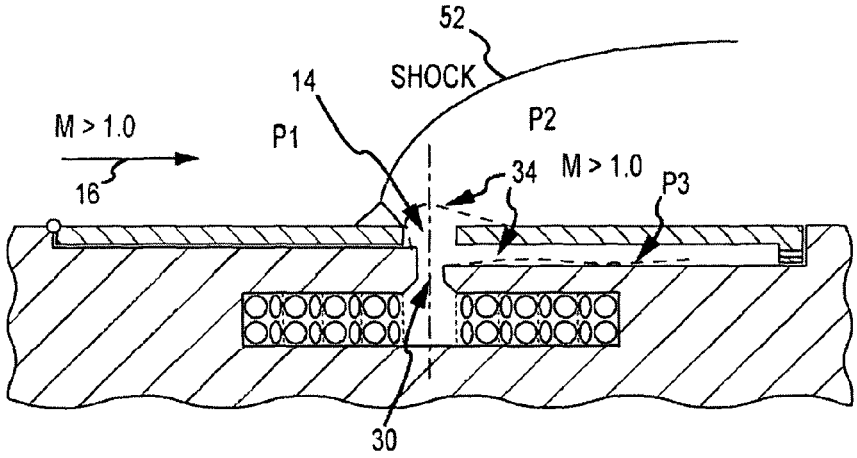
FIGS. 9*a*-9*b* are diagrams illustrating operation of the CAS at supersonic speeds in Earth atmosphere.
Figure 9B:
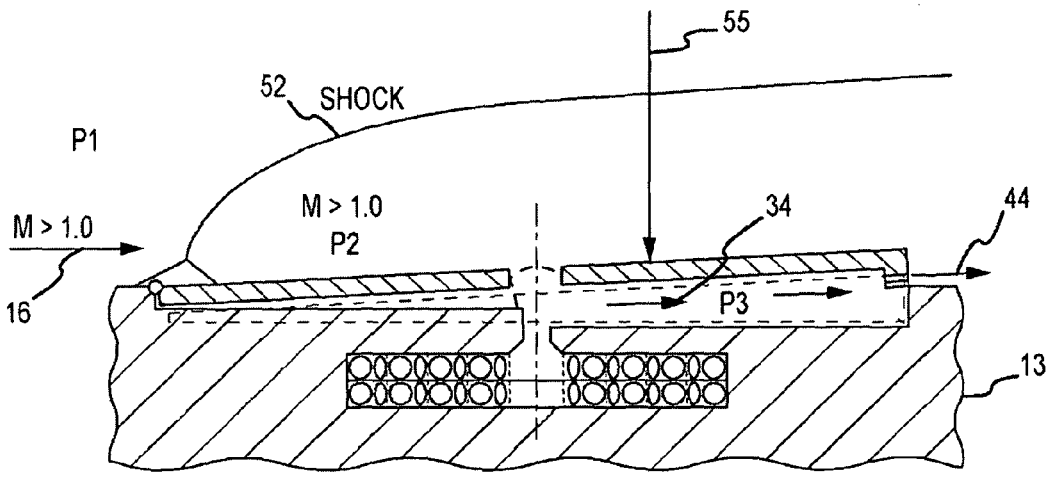

As shown in FIGS. 9*a* and 9*b*, at supersonic vehicle speeds in Earth atmosphere, when the controller ignites one or more of the propellant chambers at the same time or in a desired sequence, gas 34 is expelled into the chamber at a subsonic speed and experiences a sonic transition as it flows through the throat 30 and exits through-hole 14 at supersonic speeds (M>1.0). The expelled gas obstructs the free stream 16 producing shock 52 that restricts gas flow from the nozzle directing at least a portion of the gas into the cavity 19 to pressurize the cavity and deploy the control surface 12. At sufficiently high supersonic speeds, the free stream forms a virtual plug of the through-hole so that the PT-CAS functions the same as the P-CAS. Once the control surface is deployed, shock 52 moves back to the pivot point and exhaust gas 44 flows from the cavity to the external environment. The deployed surface produces drag in atmosphere, which in turn produces force 55 which is normal to the vehicle longitudinal axis to maneuver the airframe.

Figure 10:
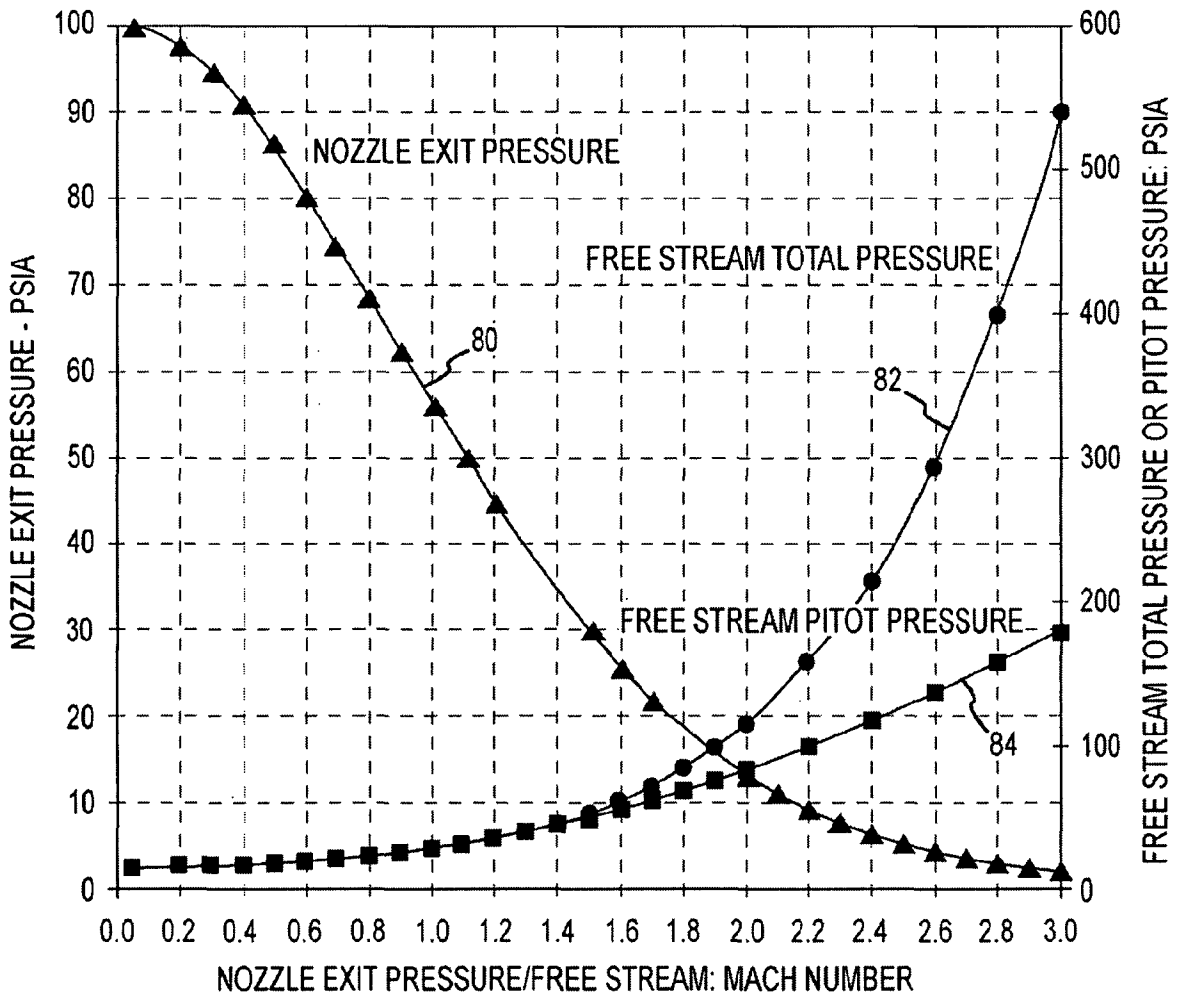
FIG. 10 is a diagram of nozzle exit and free stream total pressure dependence on nozzle exit and free stream Mach number.
Figure 11:
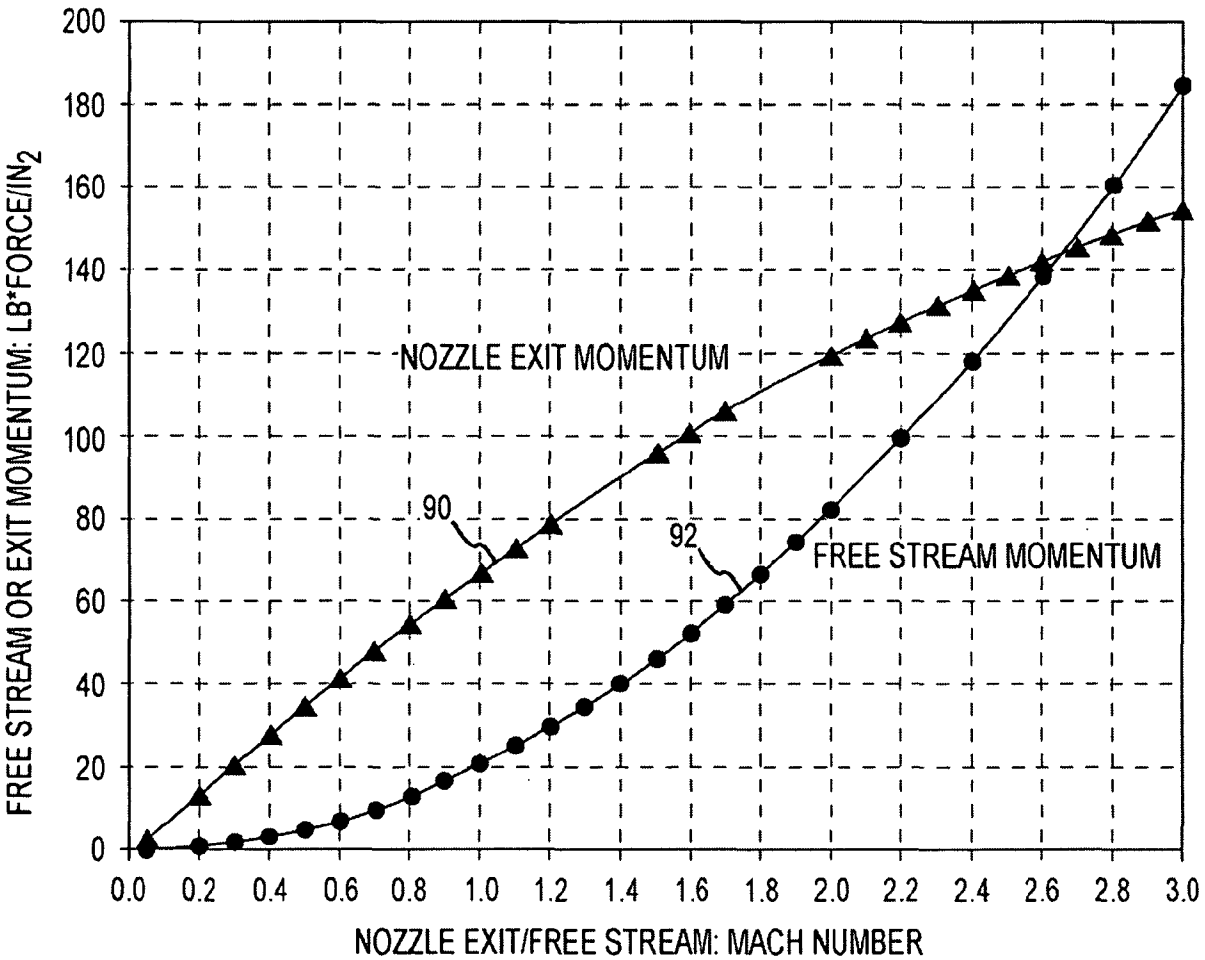
FIG. 11 is a diagram of nozzle exit and free stream momentum dependence on nozzle exit and free stream Mach number.

In general, there is a 'transition region' between the pure divert thruster region and the pure control surface region. In this transition region, command authority is a combination of divert thrust and actuation of the control surface. The Mach numbers at which the transition region starts and stops depend on a number of design and mission parameters. As described above, the controller may operate in either open or closed-loop configurations in either the transition or supersonic regions depending on mission requirements. FIGS. 10 and 11 are plots of nozzle exit and free stream total pressure and momentum versus nozzle exit and free stream Mach number, respectively. These plots illustrate the dynamics of divert thrust and control surface as vehicle velocity increases and provide insight into the design space for the solid-fuel pellet CAS with a virtual converging/diverging nozzle. In this example, the pellet chamber generates a chamber pressure of about 100 psia with a nozzle exit Mach number of about 2.0.

The nozzle exit pressure 90, free stream total pressure 92 and free stream Pitot pressure 94 that govern how the divert gas jet transitions from divert control authority to control surface control authority are shown in FIG. 10. At subsonic vehicle Mach numbers the gas from the divert jet flows freely into the freestream and does not generate a shock either on the control surface or near the nozzle exit plane. The area of the hole on the control surface external surface forms part of the nozzle. At supersonic vehicle speeds, the divert jet gas causes an obstruction to the free stream which in turn results in generation of a shock initially at the hole in the control surface. The free stream total pressure 92 represents the maximum pressure that the free stream can possibly attain. The free stream Pilot pressure 94 is the pressure downstream of a normal shock. This represents the lowest possible pressure that the free stream can attain. The actual aggregate external pressure P2 on the control surface will depend on the strength of the shock pattern and will lie somewhere between the Pitot pressure 94 and the total pressure 92.

When the external pressure in the vicinity of the nozzle exit plane (hole in the control surface) exceeds the static pressure 90 at the nozzle exit (hole in control surface) plane it will start to restrict the flow of the divert gas stream into the free stream and the cavity in the control surface will begin to be pressurized. As vehicle Mach number increases more flow will be diverted into the cavity eventually causing the control surface to move out into the free stream into the deployed position. For a nozzle exit Mach number of 2.0 and the pressures illustrated in FIG. 10, this will not occur until the vehicle Mach number is also greater than about 2.0 when the free stream total pressure and the free stream pitot pressure exceed the nozzle exit pressure. If the nozzle exit Mach number was higher than 2.0, the nozzle exit pressure would be lower and the cross over would occur at a lower free stream Mach number and vice-versa. The nozzle exit velocity can be varied by controlling the geometry and specification the area ratio of the throat and through-hole. The nozzle exit Mach number is fixed by an area ratio of the through-hole to the throat. The nozzle exit pressure for a given nozzle exit velocity can be varied by varying the chamber pressure. This can be achieved by using different amounts of propellant in each chamber or ignition of more than a single pellet. In this case for a chamber pressure of 100 psia, the nozzle produces an exit velocity of Mach 2.0 and an exit pressure of about 15 psia.

The area of through-hole 14 which forms part of the nozzle, and the area created in the cavity at the aft end of the control surface as it deploys must be controlled so that the pressure P3 is greater than the pressure P2 for the required time as determined by the guidance requirements. If the pressure P3 is not high enough, the control surface will not deploy. The through-hole inlet geometry and it's location in the control surface must be precisely controlled to maintain the required pressure (P3) in the cavity so that the control surface functions as required for the time required.

The nozzle exit momentum 90 and the free stream momentum 92 are shown in FIG. 11 for the same chamber condition (100 psia) and nozzle geometry (exit Mach number 2.0). When the nozzle exit momentum is substantially larger than the free stream momentum the gas jet from the divert nozzle will flow into the external stream with ease. As the vehicle Mach number (speed) increases the free stream momentum increases. When the free stream momentum is substantially larger than the nozzle exit plane momentum by a threshold amount, the gas from the nozzle will be almost completely restricted from flowing into the external stream and will be directed into the cavity. The Mach number at which this occurs for the nozzle and chamber configuration selected in this example is about 2.65 (free stream momentum about 145 lb*force/in$^2$ and nozzle exit momentum of 120 lb*force/in$^2$). Thus the vehicle velocity will cause the control surface to be activated at supersonic Mach numbers. The parameters that effect control surface deployment are: through-hole geometry, cavity pressure, free stream Mach number, pellet motor chamber pressure and pellet motor nozzle geometry.

For this example (nozzle exit Mach number 2.0), the control surface will begin to deploy at a free stream Mach number of about 2.0 and the divert thrust will cease at a free stream Mach number of about 2.6. Thus, the pure divert thrust region is approximately Mach 0 to about Mach 2.0, the transition region is Mach 2.0 to Mach 2.6 and the pure control surface region is approximately above about Mach 2.6. The beginning and end points and width of the transition region are set by the design parameters for the nozzle geometry, chamber pressure, size, number and firing sequence of pellets etc. in accordance with the command authority requirements for a particular flight vehicle and mission sequence.

Figure 12A:
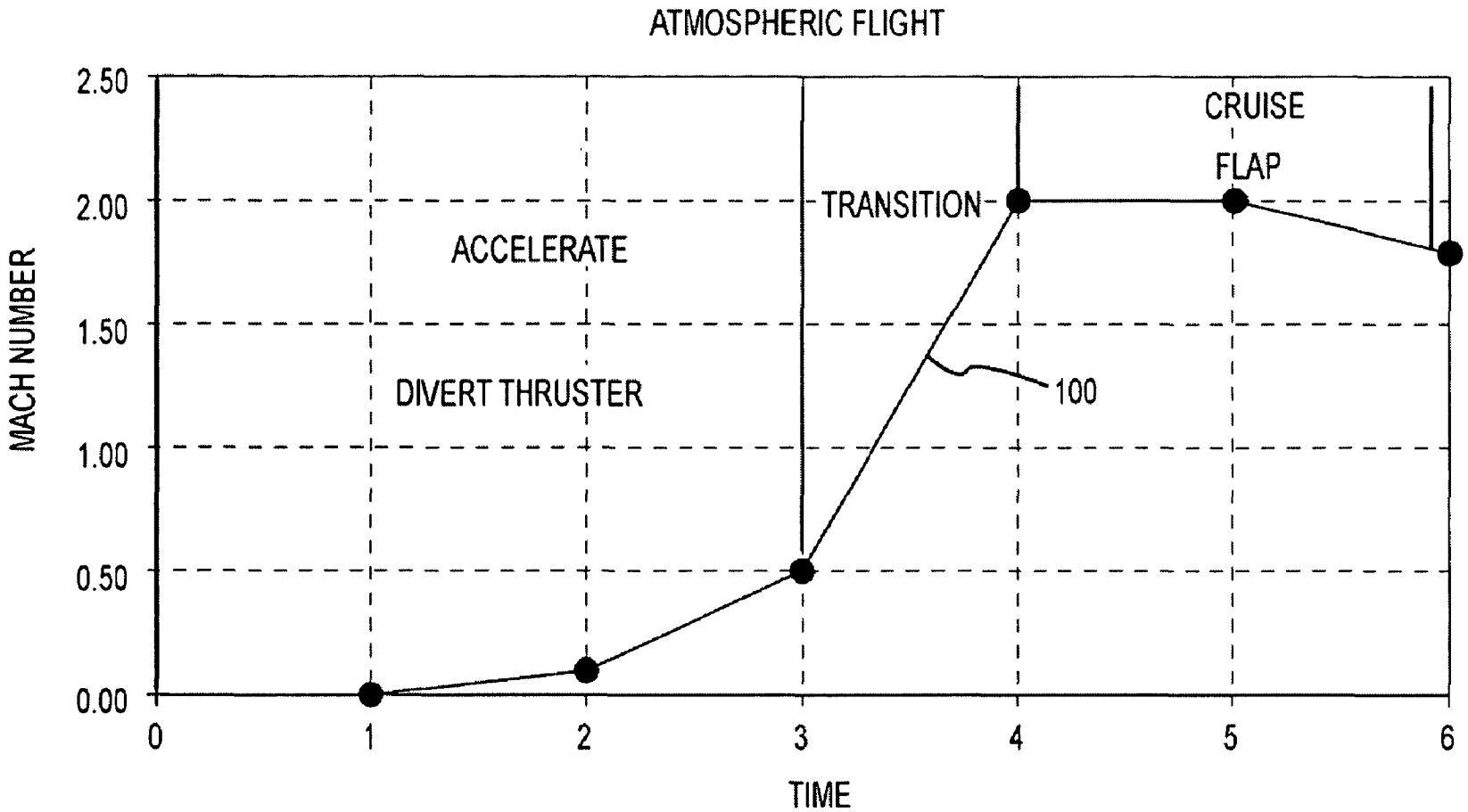
FIGS. 12*a* and 12*b* are diagrams of a typical atmospheric and exo-atmospheric flight sequences.
Figure 12B:
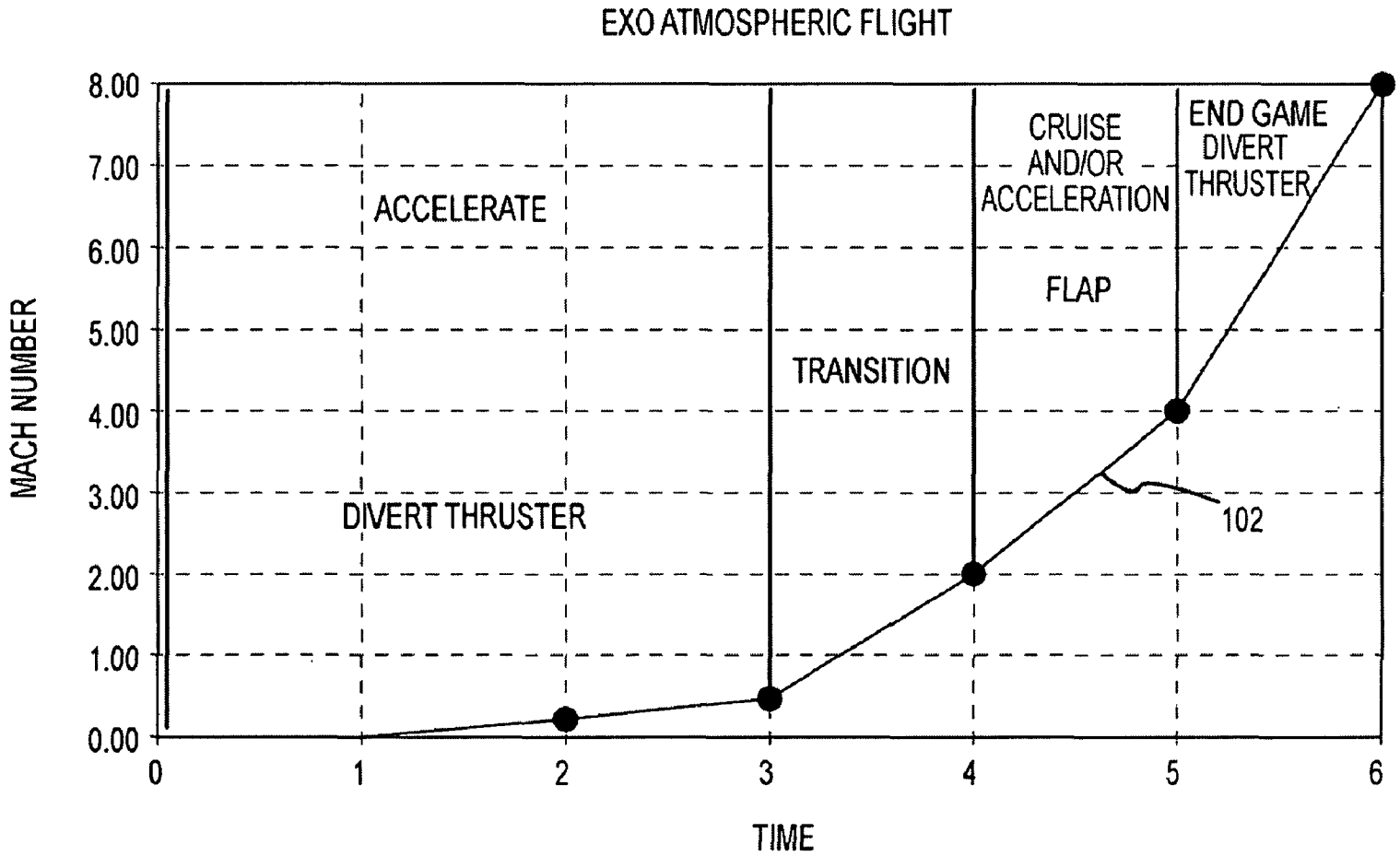

Exemplary command authority time lines 100 and 102 using the solid-pellet propellant CAS with the virtual converging/diverging nozzle for atmospheric and exo-atmospheric flight to provide guidance of the vehicle to its intended target are illustrated in FIGS. 12*a* and 12*b*, respectively.

In atmospheric flight, the vehicle is launched at time "0" and accelerates up to time "4". During acceleration in the subsonic speed regime from time "0" to time "3" where the vehicle Mach number is less than 1, command authority is obtained by firing propellant chambers to produce only a divert thruster. As the vehicle speed increases to Mach 1 and greater from time "3" to "4", command authority gradually transitions to use of the control. In this transition region, firing propellant chambers produces a combination of divert thrust and control surface drag. During cruise from time "4" to "5" command authority is achieved by firing propellant chamber to pressurize the cavity and actuate the control surface. After target acquisition and during end game engagement the vehicle targeting is accomplished by use of the control surfaces.

For a flight sequence that spans atmospheric to exo-atmospheric flight, the vehicle is launched at time "0" and accelerates up to time "4" in atmosphere. During acceleration in the subsonic speed regime from time "0" to time "3" where the vehicle Mach number is less than 1, command authority is obtained by the use of the divert thruster. As the vehicle speed increases to Mach 1 and greater from time "3" to "4", command authority transitions to use of the flap. During atmospheric cruise or acceleration from time "4" to "5" command authority is achieved by use of the control surface. Upon attaining an altitude where the ambient density is very low (exo-atmosphere), the control surface will not have sufficient authority to guide the vehicle. At this point denoted as time "5", command authority is automatically handed back to the divert thruster function. Even though the vehicle speed is supersonic, the ambient density is so low that the gas stream is not obstructed back into the cavity. After target acquisition outside of the atmosphere and during end game engagement the vehicle targeting is accomplished by use of the divert thrusters.

Figure 13:
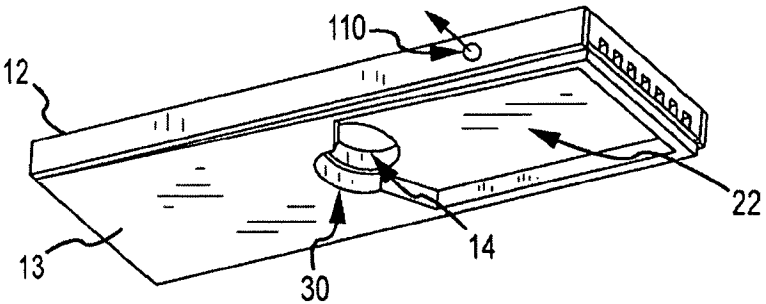
FIG. 13 is a diagram of the aero control surface including a roll control port.
Figure 14:
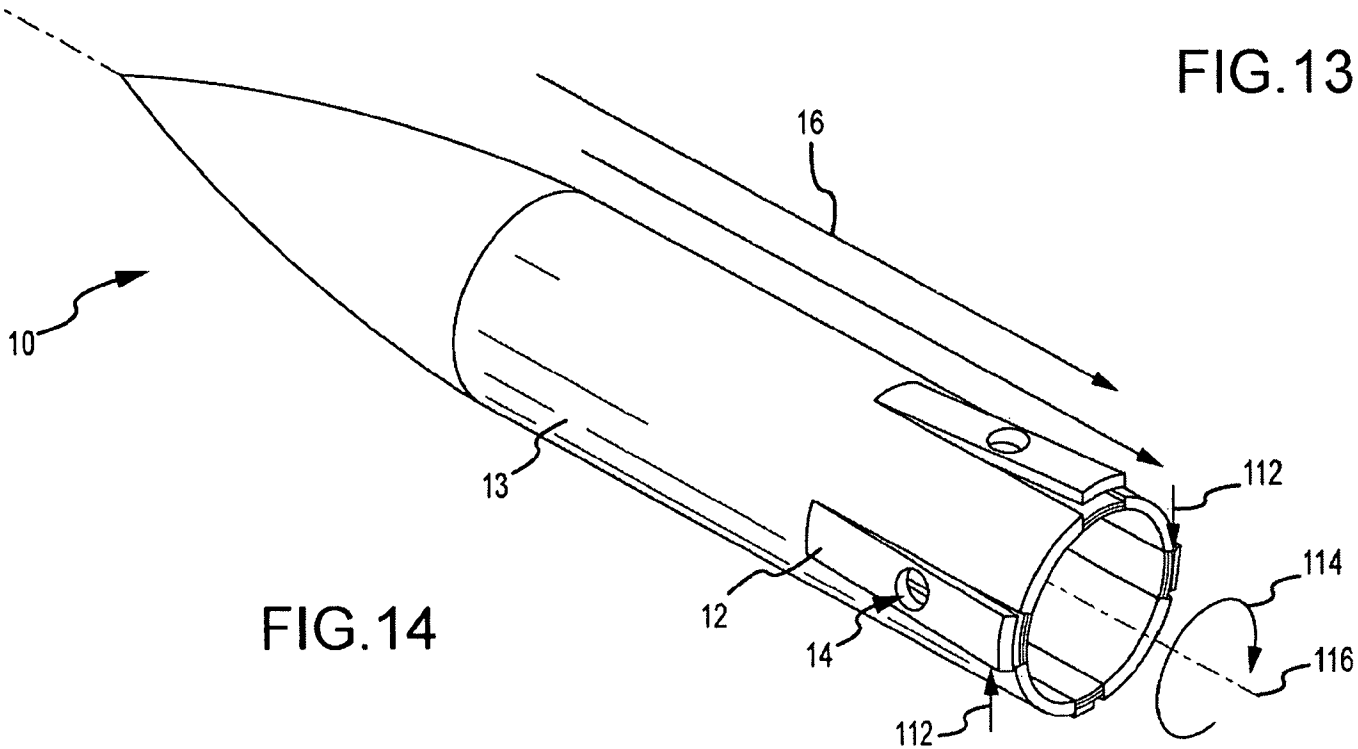
FIG. 14 is a diagram of a flight vehicle having an opposing pair of deployed aero control surfaces for providing roll control to maneuver the vehicle.

Roll control functionality can be provided in either the base P-CAS or more advanced PT-CAS embodiments by locating a roll control port 110 on the side of the aerodynamic control surface 12 as shown in FIGS. 13 and 14. Gas flowing through this port creates a force 112 on the vehicle circumferential direction (tangential to the surface of the airframe), resulting in the vehicle rotating (rolling) 114 about its longitudinal axis 116 to produce or negate roll. These ports are located on alternate sides of consecutive control surfaces.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A control actuation system (CAS) for providing command authority to maneuver an air vehicle through a free stream in an external environment, comprising:

an airframe;

at least one aerodynamic control surface on the airframe pivotable about a pivot point between a retracted position out of the free stream and deployed positions in the free stream flowing past the airfame to provide drag that maneuvers the airframe;

a cavity positioned aft of the pivot point between an all section of the control surface and the airframe;

a restrictor mechanism;

a chamber in said airframe, said chamber including one or more propellant chambers;

a throat in said airframe that couples the chamber to the cavity;

one or more solid-fuel pellets in each said propellant chamber;

an ignition system disposed to ignite the solid-fuel pellets in one or more propellant chambers to expel gas that flows through the throat into the cavity to pressurize the cavity and actuate the control surface to a deployed position, said restrictor mechanism providing a controlled bleed of gas from the cavity to the external environment in said deployed position.

2. The CAS of claim 1, wherein the CAS includes no moving parts except the aerodynamic control surface and the restrictor mechanism.

3. The CAS of claim 1, wherein at least 60% of the mass of the solid-fuel pellets is guanidine nitrate and basic copper nitrate.

4. The CAS of claim 1, wherein the plurality of pellets are produced in lots having a lot size substantially larger than the quantity required for a single CAS and tested by lot sampling.

5. The CAS of claim 1, wherein the restrictor mechanism bleeds gas from the cavity if an angle of deployment exceeds a threshold angle.

6. The CAS of claim 1, wherein the restrictor mechanism bleeds gas from the cavity at a variable rate as angle of deployment increases.

7. The CAS of claim 1, wherein the restrictor mechanism comprises an endplate coupled to a trailing edge of the control surface, said endplate having one or more vents therein.

8. The CAS of claim 1, wherein the gas bled from the cavity pressurizes a: base region of the airframe to reduce vehicle base drag.

9. The CAS of claim 1, further comprising:

a fabric bag disposed in said cavity and coupled to the throat so that the gas inflates the bag to deploy the control surface, said fabric having a porosity that forms the restrictor mechanism to control the bleed of gas from the cavity.

10. The CAS of claim 1, wherein the control surface includes a recess in its aft section that defines said cavity.

11. The CAS of claim 1, wherein a recess in the air frame defines said cavity.

12. The CAS of claim 1, wherein at least one pair of said aerodynamic control surfaces are positioned on the airframe opposite each other, each control surface including a roll control port oriented to bleed gas from the cavity in a circumferential direction when the pair of opposite aerodynamic control surfaces are deployed to cause the vehicle to roll or to negate roll about its longitudinal axis.

13. The CAS of claim 1, further comprising:

a through-hole in a fore section of the control surface above the throat, said throat and through-hole forming a virtual converging/diverging nozzle so that the expelled gas experiences a sonic transition as the gas flows through the throat.

14. The CAS of claim 13, wherein diameter of the through-hole is greater than the diameter of the throat.

15. The CAS of claim 13, wherein said virtual converging/diverging nozzle is configured so that at subsonic air vehicle speeds in atmosphere or any speed outside the atmosphere said nozzle ejects gas at supersonic speed producing a divert thrust to maneuver the airframe without deploying the control surface and at supersonic air vehicle speeds in atmosphere the expelled gas obstructs the free stream producing a shock that restricts gas flow from the nozzle directing at least a portion of the gas into the cavity to pressurize the cavity and deploy the control surface.

16. The CAS of claim 15, wherein the virtual converging/diverging nozzle is configured so that at an air vehicle speed of Mach 1 the exit pressure of the ejected gas exceeds the free stream total pressure by a threshold amount.

17. The CAS of claim 15, wherein the virtual converging/diverging nozzle is configured so that at air vehicle speeds in a transition region between approximately Mach 1 and a higher supersonic threshold both divert thrust and surface deployment combine to maneuver the airframe and above the supersonic threshold the divert thrust is approximately zero.

18. The CAS of claim 15, further comprising:

a controller that issues a first command to the ignition system to ignite the solid-fuel pellets in one or more propellant chambers at a subsonic vehicle speed in Earth atmosphere to produce a first divert thrust to maneuver the airframe and issues a second command to the ignition system to ignite the solid-fuel pellets in one or more propellant chambers at a supersonic vehicle speed in Earth atmosphere to pressurize the cavity to deploy the control surface to maneuver the airframe.

19. The CAS of claim 18, wherein the controller issues a third command to the ignition system to ignite the solid-fuel pellets in one or more propellant chambers outside Earth atmosphere to produce a second divert thrust to maneuver the airframe.

20. A control actuation system (CAS) for providing command authority to maneuver an air vehicle through a free stream in an external environment, comprising:

an airframe;

at least one aerodynamic control surface on the airframe pivotable about a pivot point between a retracted position out of the free stream and deployed positions in the free stream flowing past the airfame to provide drag that maneuvers the airframe;

a cavity positioned aft of the pivot point between an aft section of the control surface and the airframe;

a restrictor mechanism coupled to the aft section of the control surface to provide a controlled bleed of gas from the cavity to the external environment in the deployed position;

a chamber in said airframe, said chamber including one or more propellant chambers;

a throat in said airframe that couples the chamber to the cavity;

a through-hole in a fore section of the control surface above the throat, said throat and through-hole forming a virtual converging/diverging nozzle one or more solid-fuel pellets in each said propellant chamber;

an ignition system disposed to ignite the solid-fuel pellets in one or more propellant chambers to expel gas that experiences a sonic transition as it flows through the throat; and a controller configured to issue first ignition commands to the ignition system so that the nozzle ejects gas at supersonic speed producing a divert thrust to maneuver the airframe without deploying the control surface and to issue second ignition commands to the ignition system so that the expelled gas obstructs the free stream producing a shock that restricts gas flow from the nozzle directing at least a portion of the gas into the cavity to pressurize the cavity and deploy the control surface.

21. The CAS of claim 20, wherein the CAS includes no moving parts except the aerodynamic control surface and the restrictor mechanism.

22. The CAS of claim 20, wherein at least 60% of the mass of the solid-fuel pellets is guanidine nitrate and basic copper nitrate.

23. The CAS of claim 20, wherein the plurality of pellets are produced in lots having a lot size substantially larger than the quantity required for a single CAS and tested by lot sampling.

24. The CAS of claim 20, wherein at least one pair of said aerodynamic control surfaces are positioned on the airframe opposite each other, each control surface including a roll control port oriented to bleed gas from the cavity in a circumferential direction when the pair of opposite aerodynamic control surfaces are deployed to cause the vehicle to roll or to negate roll about its longitudinal axis.

25. The CAS of claim 20, wherein said controller is configured to issue the first ignition commands at subsonic vehicle speeds in atmosphere or at any speed outside the atmosphere and to issue the second ignition commands at supersonic vehicle speeds in atmosphere.

26. The CAS of claim 25, wherein the virtual converging/diverging nozzle is configured so that at a vehicle speed of Mach 1 the exit pressure of the ejected gas exceeds the free stream total pressure by a threshold amount.

27. The CAS of claim 25, wherein the virtual converging/diverging nozzle is configured so that at air vehicle speeds in a transition region between approximately Mach 1 and a higher supersonic threshold both divert thrust and surface deployment combine to maneuver the airframe and above the supersonic threshold the divert thrust is approximately zero.

* * * * *

UNITED STATES PATENT AND TRADEMARK OFFICE

CERTIFICATE OF CORRECTION

PATENT NO. : 8,193,476 B2
APPLICATION NO. : 12/203302
DATED : June 5, 2012
INVENTOR(S) : Olden et al.

It is certified that error appears in the above-identified patent and that said Letters Patent is hereby corrected as shown below:

In column 10, claim 1, line 31, delete “all” and insert --aft--;

In column 10, claim 8, line 66, delete the “:” after the “a”.

Signed and Sealed this
Fourteenth Day of August, 2012

David J. Kappos

David J. Kappos
*Director of the United States Patent and Trademark Office*